US007978036B2

(12) United States Patent
Adunka et al.

(10) Patent No.: US 7,978,036 B2
(45) Date of Patent: Jul. 12, 2011

(54) METHOD AND DEVICE FOR THE SECURE OPERATION OF A SWITCHING DEVICE

(75) Inventors: Robert Adunka, Sulzbach-Rosenberg (DE); Peter Hartinger, Bodenwöhr (DE); Bardo Koppmann, Kaltenbrunn (DE); Norbert Mitlmeier, Ursensollen (DE); Ludwig Niebler, Laaber (DE); Fritz Pohl, Hemhofen (DE); Alf Wabner, Amberg (DE); Norbert Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 864 days.

(21) Appl. No.: 11/793,753

(22) PCT Filed: Dec. 22, 2005

(86) PCT No.: PCT/EP2005/057074

§ 371 (c)(1),
(2), (4) Date: Jun. 21, 2007

(87) PCT Pub. No.: WO2006/069957

PCT Pub. Date: Jul. 6, 2006

(65) Prior Publication Data

US 2008/0110732 A1 May 15, 2008

(30) Foreign Application Priority Data

Dec. 23, 2004 (DE) ..... 10 2004 062 270

(51) Int. Cl.
*H01H 67/02* (2006.01)
*H01H 75/00* (2006.01)
*H01H 77/00* (2006.01)
*H01H 83/00* (2006.01)

(52) U.S. Cl. ..... 335/132; 335/8

(58) Field of Classification Search ..... 335/8–10, 335/132

See application file for complete search history.

(56) References Cited

U.S. PATENT DOCUMENTS 4,292,611 A * 9/1981 Bresson et al. ..... 335/6

(Continued)

FOREIGN PATENT DOCUMENTS

EP 0 224 081 6/1987

(Continued)

OTHER PUBLICATIONS

International Search Report dated Mar. 17, 2006.

*Primary Examiner* — Elvin G Enad
*Assistant Examiner* — Alexander Talpalatskiy
(74) *Attorney, Agent, or Firm* — Harness, Dickey & Pierce, P.L.C.

(57) ABSTRACT

A method and a device are disclosed for the secure operation of a switching device including at least one main contact which can be switched on and off and which includes contact pieces and a displaceable contact bridge, and at least one control magnet which includes a displaceable anchor. The anchor and the contact bridge are actively connected to each other such that the corresponding main contact can be opened or closed when switched on and off. In at least one embodiment, the method includes the following: a) the path difference, which returns the anchor after switching on and off, is recognised, b) devices which are used to open welded main contacts are released by a release device when the recognised path difference exceeds a predetermined value and a specific time duration of time has run out after switching off.

22 Claims, 8 Drawing Sheets

U.S. PATENT DOCUMENTS

| | | | | | |
|---|---|---|---|---|---|
| 4,470,028 | A | * | 9/1984 | Vayre et al. | 335/16 |
| 4,473,860 | A | * | 9/1984 | Thomas | 361/139 |
| 4,737,749 | A | | 4/1988 | Held | |
| 4,931,757 | A | * | 6/1990 | Lemmer et al. | 335/131 |
| 5,163,175 | A | * | 11/1992 | Mori et al. | 335/132 |
| 5,243,291 | A | * | 9/1993 | Umemura | 324/418 |
| 5,252,933 | A | * | 10/1993 | Kamino et al. | 335/172 |
| 5,455,733 | A | | 10/1995 | Waggamon | |
| 5,668,693 | A | | 9/1997 | Tennies et al. | |
| 5,880,658 | A | * | 3/1999 | Donhauser et al. | 335/132 |
| 6,023,110 | A | * | 2/2000 | Henrion et al. | 307/125 |
| 6,150,909 | A | * | 11/2000 | Meier | 335/132 |
| 6,411,184 | B1 | * | 6/2002 | Comtois et al. | 335/106 |
| 6,566,618 | B2 | * | 5/2003 | Hamada et al. | 200/308 |
| 6,833,777 | B2 | * | 12/2004 | Bollinger et al. | 335/6 |
| 2002/0063049 | A1 | * | 5/2002 | Hamada et al. | 200/308 |

FOREIGN PATENT DOCUMENTS

| | | | |
|---|---|---|---|
| EP | 0 224 081 | B1 | 2/1991 |
| EP | 0 694 937 | | 1/1996 |
| EP | 0 694 937 | B1 | 3/2000 |
| EP | 0 832 496 | B1 | 5/2001 |
| EP | 1 298 689 | A2 | 4/2003 |
| JP | 1092284 | A | 4/1989 |
| JP | 3149722 | A | 6/1991 |
| JP | 2004055497 | A | 2/2004 |

* cited by examiner

METHOD AND DEVICE FOR THE SECURE OPERATION OF A SWITCHING DEVICE

PRIORITY STATEMENT

This application is the national phase under 35 U.S.C. §371 of PCT International Application No. PCT/EP2005/057074 which has an International filing date of Dec. 22, 2005, which designated the United States of America and which claims priority on German Patent Application number 10 2004 062 270.1 filed Dec. 23, 2004, the entire contents of which are hereby incorporated herein by reference.

FIELD

At least one embodiment of the present invention generally relates to a method for safe operation of a switching device, and/or to a corresponding apparatus.

BACKGROUND

Switching devices, in particular low-voltage switching devices, can be used to switch the current paths between an electrical supply device and loads, and therefore to switch their operating currents. This means that the switching device opens and closes current paths, allowing the connected loads to be safely connected and disconnected.

An electrical low-voltage switching device, such as a contactor, a circuit breaker or a compact starter, has one or more so-called main contacts, which can be controlled by one or else more control magnets, in order to switch the current paths. In principle, in this case, the main contacts include a moving contact link and fixed contact pieces, to which the loads and the supply device are connected. In order to close and open the main contacts, an appropriate connection or disconnection signal is passed to the control magnets, in response to which their armatures act on the moving contact links such that the latter carry out a relative movement with respect to the fixed contact pieces, and either close or open the current paths to be switched.

Appropriately designed contact surfaces are provided in order to improve the contact between the contact pieces and the contact links at points at which the two meet one another. These contact surfaces are composed of materials such as silver alloys, which are applied at these points both to the contact link and to the contact pieces, and have a specific thickness.

The materials of the contact surfaces are subject to wear during every switching process. Factors which can influence this wear are:

- increasing contact erosion or contact wear as the number of connection and disconnection processes increases,
- increasing deformation,
- increasing contact corrosion caused by arcing, or
- environmental influences, such as vapors or suspended particles, etc.

This results in the operating currents no longer being safely switched, which can lead to current interruptions, contact heating or to contact welding.

For example, particularly as the contact erosion increases, the thickness of the materials applied to the contact surfaces will decrease. The switching movement between the contact surfaces of the contact link and contact pieces therefore becomes longer, thus in the end reducing the contact force on closing. As the number of switching processes increases, this results in the contacts no longer closing correctly. The resultant current interruptions or else the increased connection bouncing can then lead to contact heating and thus to increasing melting of the contact material, which can in turn then lead to welding of the contact surfaces of the main contacts.

If a main contact of the switching device has become worn or even welded, the switching device can no longer safely disconnect the load. In particular in the case of a welded contact, at least the current path with the welded main contact will still continue to carry current and will still be live, despite the disconnection signal, so that the load is not completely isolated from the supply device. Since, in consequence, the load remains in a non-safe state, the switching device represents a potential fault source. In the case of compact starters according to IEC 60 947-6-2, for example, in which the protection mechanism acts on the same switching point as the electromagnetic drive during normal switching, this can thus result in the protective function being blocked. Fault sources such as these in particular must, however, be avoided for safe operation of switching devices, and therefore for protection of the load and of the electrical installation.

SUMMARY

At least one embodiment of the present invention is used to identify potential fault sources, and to react appropriately to them.

At least one embodiment of the present invention allows contact welding during disconnection and thus the fact that the operation of the switching device is no longer safe to be identified with little complexity, in order to allow the situation to be reacted to appropriately.

According to at least one embodiment of the invention, a movement distance difference which the armature travels after connection or disconnection is identified for this purpose, and means are initiated for breaking open welded main contacts, that is to say closed main contacts, by way of an initiation device when the identified movement distance difference is less than a predetermined value and a specific time period has elapsed after disconnection.

The predetermined value will in this case correspond to a determined movement distance difference at which the contact link when the control magnet is disconnected is just still connected to the contact pieces, so that it can be assumed that welding has occurred. In this case, the movement distance difference can be determined directly adjacent to the armature, or else adjacent to the contact link which is operatively connected to the armature, or adjacent to the means which produce this operative connection. This identification of the movement distance difference may, for example, be carried out by way of a connection between the armature and the initiation lever, for example by way of a mechanical coupling device, which no longer exerts any force on the initiation lever when the movement distance difference traveled by the armature is not less than the predetermined value.

If the movement distance difference traveled by the armature after a predetermined time period has elapsed is less than this predetermined value, then it can be assumed that welding has occurred, and therefore that the operation of the switching device is not safe. These welded main contacts can be broken open again, and thus opened, by the initiation of appropriate device for breaking open the welded main contacts. In addition, the non-safe operation of the switching device can be indicated by further measures, such as disconnection of the switching device and/or production of appropriate warning signals.

Further advantageous embodiments and preferred developments of the invention are specified in the figures and in the disclosure below.

BRIEF DESCRIPTION OF THE DRAWINGS

The invention as well as advantageous example embodiments of it will be described in more detail in the following text with reference to the following figures, in which.

DETAILED DESCRIPTION OF THE EXAMPLE EMBODIMENTS

Figure 1:
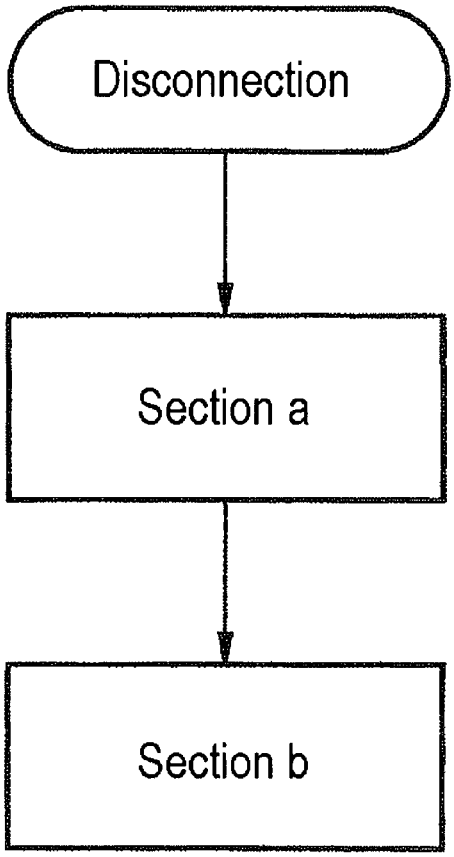
FIG. 1 shows a simplified flowchart of the method according to an embodiment of the invention.

As illustrated in FIG. 1, the two following steps are essentially carried out in the method according to an embodiment of the invention:

step a) identification of a movement distance difference which the armature or a component which is mechanically connected to the armature (120) travels after connection or disconnection, and step b) initiation of device for breaking open welded main contacts by way of an initiation device when the identified movement distance difference is less than a predetermined value and a specific time period has elapsed after disconnection.

The idea on which the method according to an embodiment of the invention is based is in this case that the initiation device has a predetermined time inertia and thus a response time, which is also referred in the following text as the required initiation time, which is greater during normal switching operation than an initiation time window defined by the complete armature movement. The initiation time window is used synonymously for the disconnection time in the following text. This ensures that initiation takes place only in the case of contact welding, specifically when the armature travels through only a short movement distance difference, owing to the contacts being welded, after a time period defined by the predetermined inertia.

This initiation process allows an appropriate device, for example a force energy store such as a latching mechanism, to be unlocked in order to break open the welded main contact or contacts. In addition, a further switching element can be provided, which blocks further operation of the switching device in the event of initiation, thus blocking the switching device until it has been reset. The blocking of normal switching can furthermore be indicated and/or processed further by way of a display, by means of a mechanical indication and reset element, by way of a signaling contact or via a data bus.

Various embodiments of the apparatus according to the invention will be described in more detail in the following text using the example of a contactor.

During fault-free and therefore safe operation of the switching device, during normal disconnection of the control magnet 110, which is illustrated by way of example in FIG. 2, the magnet armature 120 will move in the opening direction after the magnetic force FM has fallen below the value of a spring opening force in the opposite direction to a tension spring 130. After an opening movement of a few millimeters, for example 2 mm, the mechanical operating elements which are coupled to the armature 120, but are not illustrated in any more detail here, strike the contact link of the main contact or contacts of the switching device. As the opening movement of the magnet armature 120 continues further, the contact link is moved to its final open position.

The entire armature movement distance Δx from the connected position with the main contact closed to the disconnected position with the main contact open may thus be about 6 mm. A typical opening speed of between 0.5 m/s and 2 m/s is reached during the accelerated opening movement of the magnet armature 120 from the connected position to the disconnected position in the case of circuit breakers and contactors. In the event of contact welding, the opening movement of the armature in the present example is braked abruptly after an opening movement of 2 mm. After a further opening movement of perhaps one millimeter, the armature movement is then stopped completely, once the mechanical play has been overcome and the deformation has formed.

The difference Δx in the armature movement distance between the unwelded case and welded state of the contacts is thus about 3 mm. This movement distance difference Δx is then traveled, for example, in 1.5 ms in the non-welded case, which corresponds to a speed of v=2 m/s, or in 6 ms, which corresponds to a speed of v=0.5 m/s. If this movement distance difference Δx is regarded as a mechanical initiation window, then this corresponds to an initiation time window with a time duration of 1.5 ms or 6 ms. The inert initiation mechanism must therefore satisfy the condition of not responding during this short time window during safe operation.

A first embodiment of the apparatus according to the invention will now be explained with reference to FIG. 2.

In this case, the apparatus has an initiation lever 150, which is mounted such that it can rotate, as the initiation device. This initiation lever 150 is held captive without contact being made by the magnetic force FM of a permanent magnet 151, which is firmly connected to the initiation lever 150, against a counteracting force FF of an initiation spring 170 on a movable ferromagnetic slotted link 160. The ferromagnetic slotted link 160 consists of a metal sheet with a recess 161 and, during a closing and opening movement, is moved together with the magnet armature 120, by being coupled 140 to it. The permanent magnet 151 and the slotted link 160 are now positioned with respect to one another such that, in the event of contact welding, that is to say an armature movement of a few millimeters, the slotted-link recess 161 is opposite the permanent magnet 151 so that its magnetic holding force FM falls below the value of the initiation spring force of the spring 170 in the opposite direction.

Thus, the holding force FM only decreases when the slotted-link recess 161 is opposite the permanent magnet 151, because the armature has traveled through only a movement distance difference Δx which is less than a specific value, in the present example 3 mm. Since, as a result of the welding, the slotted link 160 does not move any further, there is a continuous excess force from the initiation spring 170, so that, once the time period predetermined by the time inertia has elapsed, the initiation lever 150 is moved to the initiation position, and, for example, a latching mechanism 180 is therefore unlatched.

The contact welding can then be broken open by a correspondingly high spring force of the latching mechanism 180, which acts on the main contact 126, as a result of which the armature 120 is moved with the contact links 125 to the disconnected position. In this situation, in which the latching mechanism 180 moves to a disconnected position or initiation position, it may be expedient to link this latching-mechanism position with disconnection of the control circuit for the magnet drive 110 in order to protect the switching device against further operation, for fault identification. The initiation lever 150 is then reset again to the state in which it is held against the ferromagnetic slotted link 160 by the magnetic force FM of the permanent magnet 151, with the initiation apparatus for further safe operation therefore being interlocked, only by means of active acknowledgement or resetting, for example in the course of a maintenance measure on the switching device.

Figure 2:
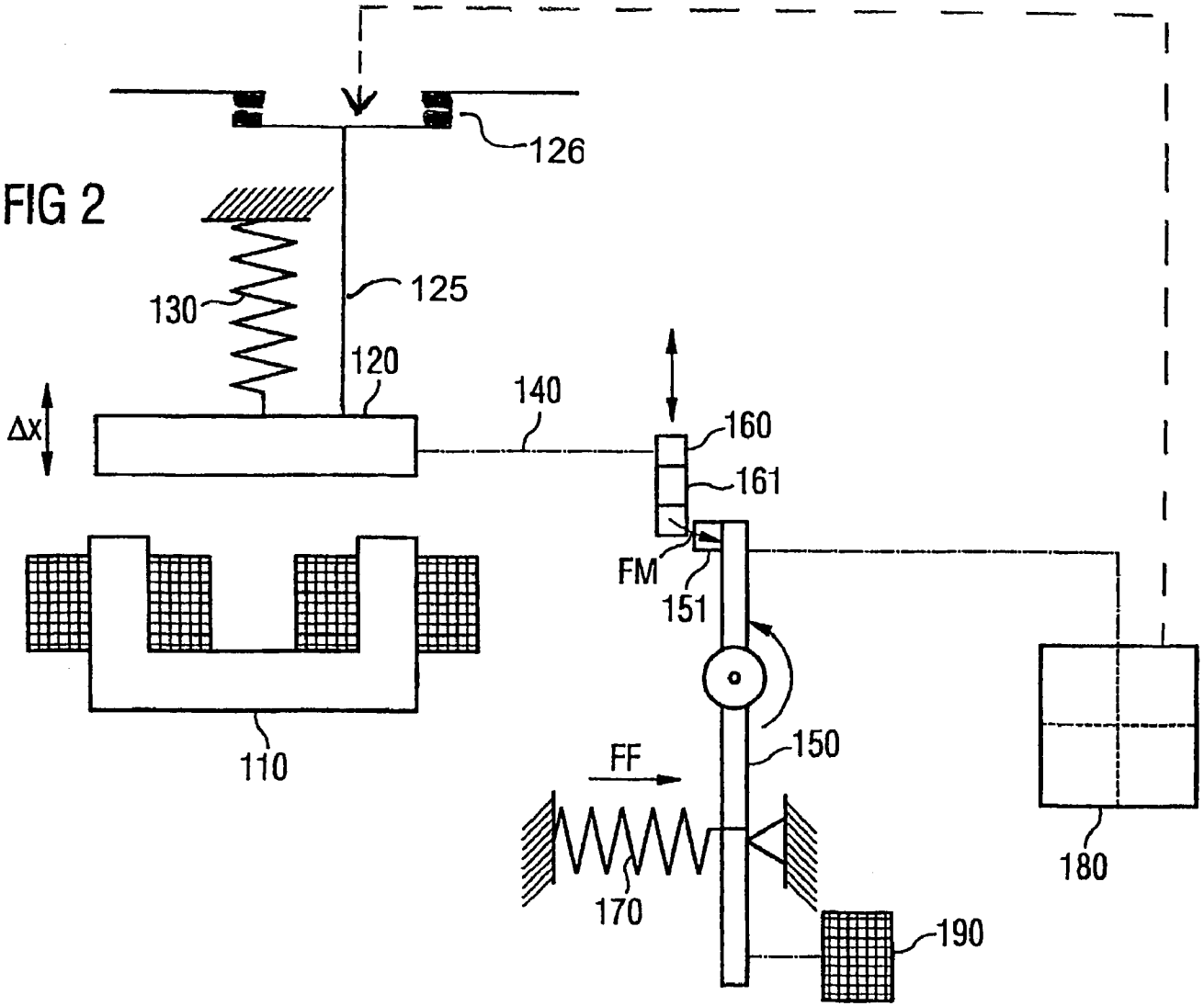
FIG. 2 shows a first embodiment of the apparatus according to the invention.

In addition, as is illustrated in FIG. 2, it is possible to provide for the initiation function for overcoming contact welding to be inhibited during connection of the magnet drive 110. For example, it is possible to avoid the problem that the initiation time window is greater than the response time of the initiation mechanism owing to the low armature closing speed. This makes it possible to avoid spurious initiation. For this purpose, the initiation lever 150 is held in the "non-initiated position" by way of an additional magnet coil 190, which is switched on at the same time as the magnet drive 110.

In addition, it is possible to provide for the time inertia of the initiation mechanism to be increased during the disconnection process by the magnet coil 190 still being energized with current after interruption of the supply voltage and thus of the control voltage by way of a charge capacitor for a limited time, during which the slotted-link window passes the permanent magnet.

As a further embodiment variant, additional holding of the initiation lever 150 during connection of the magnet drive 110 can be achieved by the magnetic stray field (which is not illustrated in any more detail) of the armature air gap exerting a holding force FM on a component which is connected to the initiation lever 150. In the case of constant-field magnetic excitation, this may be the permanent magnet 151 of the initiation lever 150 and, in the case of magnetic alternating-field excitation, it may be an additional ferromagnetic component, fitted to the initiation lever 150.

Figure 3:
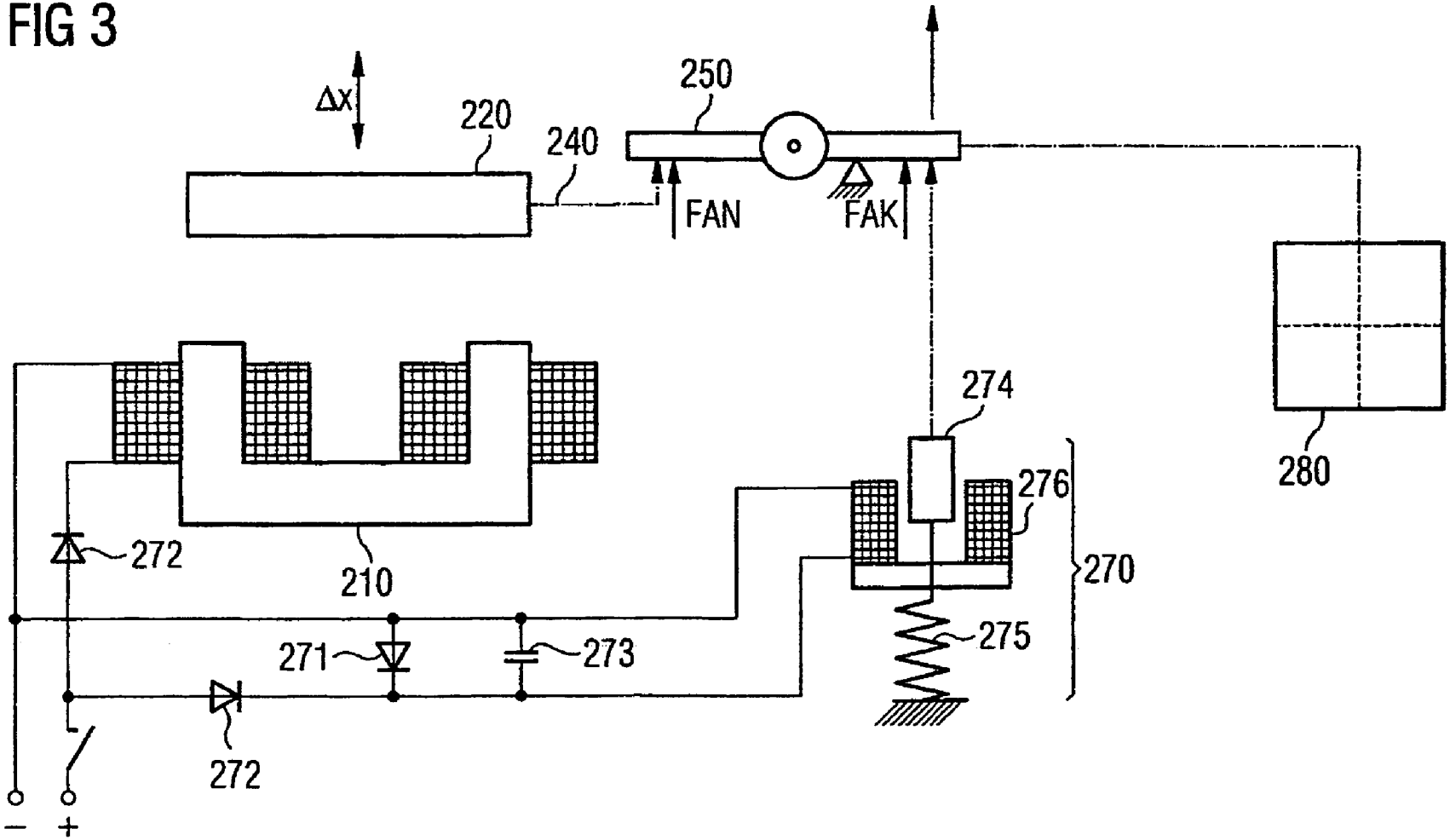
FIG. 3 shows a second embodiment of the apparatus according to the invention.

FIG. 3 shows a second embodiment of the apparatus according to the invention. The entire armament movement distance from the connected position to the disconnected position is considered to be the mechanical initiation window in this case. An initiation time window with a width of, for example, 10-20 milliseconds corresponds to this if, in the example of the contactor, the mean opening speed of the armature is between 0.3 m/s and 0.6 m/s. The initiation time window can also be increased by the decay time of the magnetic field after the disconnection command from the control circuit. As in the case of FIG. 2, the inert initiation mechanism from FIG. 3 must therefore satisfy the condition of not responding during this initiation time window.

For this purpose, the initiation mechanism contains a blocking device, such as a blocking lever 240, which can be operated by the magnet armature 220 of the magnet drive 210 used for normal operation, and an initiation device, such as an initiation lever 250, which is operated by an additional actuator 270. The blocking device 240 and the initiation device 250 are linked to one another in such a way that initiation is possible only in the unblocked state. One option for doing this is for the blocking lever 240 and the initiation lever 250 to form a mechanical unit, and for the blocking force FAN of the magnet armature 220 to be considerably greater than the initiation force FAK of the actuator 270.

Alternatively, the blocking lever 240, the initiation lever 250 and the mechanical operative connection, which is shown in the form of a dashed-dotted arrow in FIG. 3, to the plunger-type armature 274 of the additional armature 270 may be in the form of a mechanical unit. In order to prevent initiation when welding has not occurred, the initiation device 250 must be blocked by the magnet armature 220 before the actuator 270 attempts initiation. The initiation time window is in this case too short for initiation by way of the actuator 270. The actuator 270 is for this purpose provided with an inert response for the disconnection process. In this case, a magnetic initiator of known design can be used as the actuator 270.

In the case of a contactor with a DC magnet drive, the inert response of this magnetic initiator 270 can be produced by way of a freewheeling circuit, that is to say by way of a freewheeling diode 271 connected in parallel with the magnetic initiator 270. The control circuits for the DC magnet drive 210 and for the magnetic initiator 270 are in this case electrically decoupled from one another, for example by way of a diode circuit. During connection of the magnetic drive 210, the magnetic initiator 270 is connected at the same time, and the magnetic initiator armature 274 is in this case moved to the non-initiation position, where it is mechanically held against the initiator spring 275 for as long as the armature 220 also remains in the connected state.

During disconnection of the DC magnet drive 210, the magnetic initiator 270 is disconnected at the same time. The freewheeling circuit 271, 276 delays the decay of the magnetic field on the magnetic initiator 270, and the magnetic initiator armature 274 drops out only after a delay time. An addition delay is achieved in that a charge capacitor 273, which is connected in parallel with the freewheeling circuit 271, 276, still supplies the magnetic initiator 270 with a voltage for a predetermined time period via the disconnection signal of the magnet drive 210.

Figure 6:
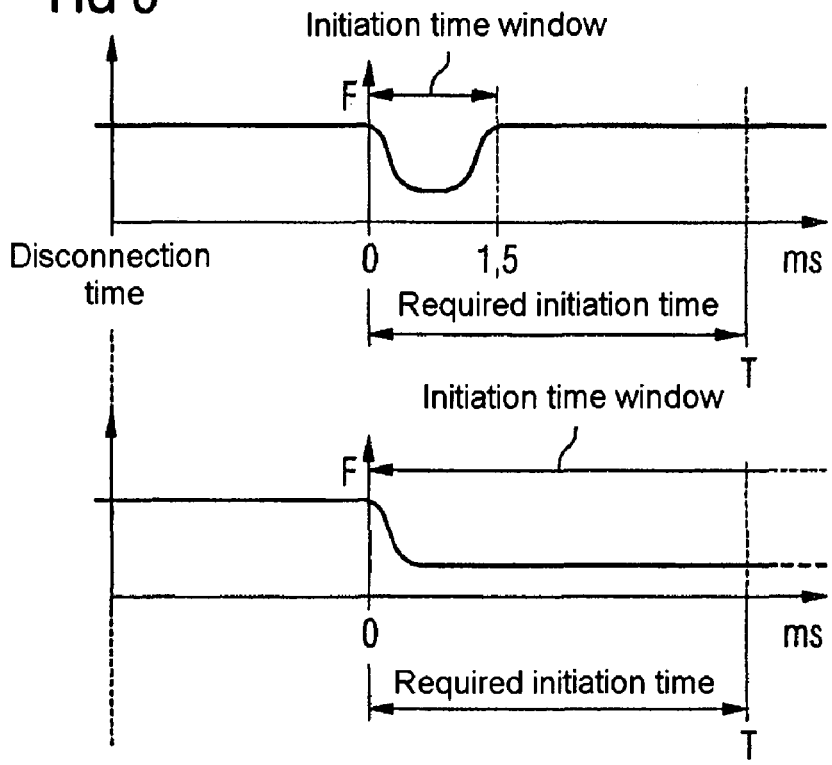
FIGS. 6, 7 show schematic illustrations of the time profiles of characteristic variables relating to FIG. 2 and FIG. 3.
Figure 7:
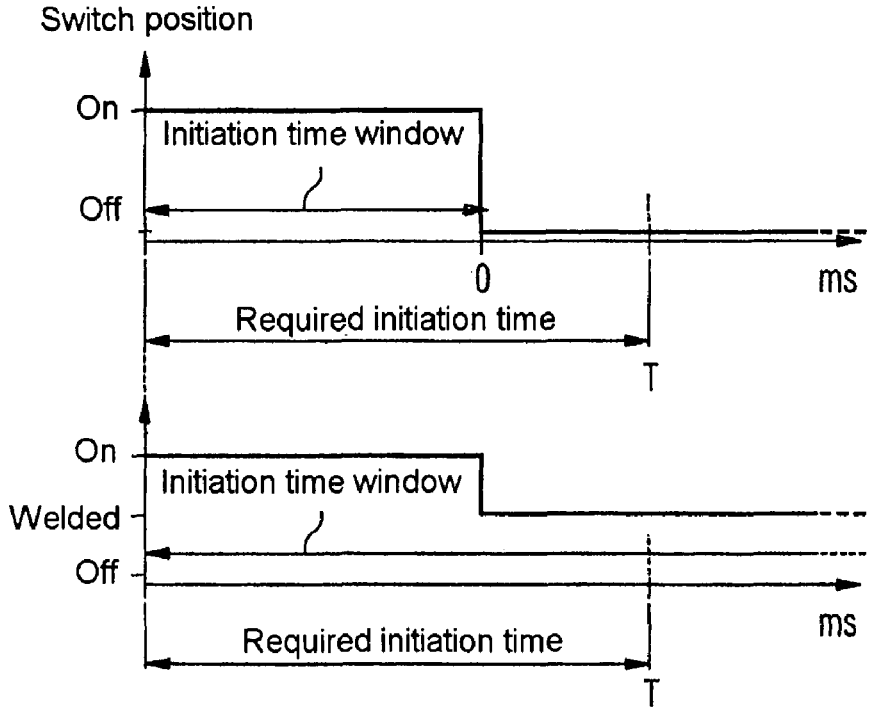

FIGS. 6 and 7 show the corresponding diagrams for the forces acting after disconnection and, respectively, the switch position after disconnection for the two embodiments illustrated in FIG. 2 and FIG. 3. In this case, the upper diagram in FIG. 6, in particular, shows the force/time diagram for the first embodiment, as illustrated in FIG. 2, during normal operation, that is to say operation without welding, and the lower diagram in FIG. 6 shows the force/time diagram during faulty operation, that is to say welded operation. In a corresponding manner, the upper diagram in FIG. 7 shows the switch position of the embodiment illustrated in FIG. 3 during normal operation, and the lower diagram in FIG. 7 shows the same embodiment during faulty operation. The time period which must elapse in this case for the method according to an embodiment of the invention and for the apparatus according to an embodiment of the invention is annotated with $\tau$ here.

Figure 4:
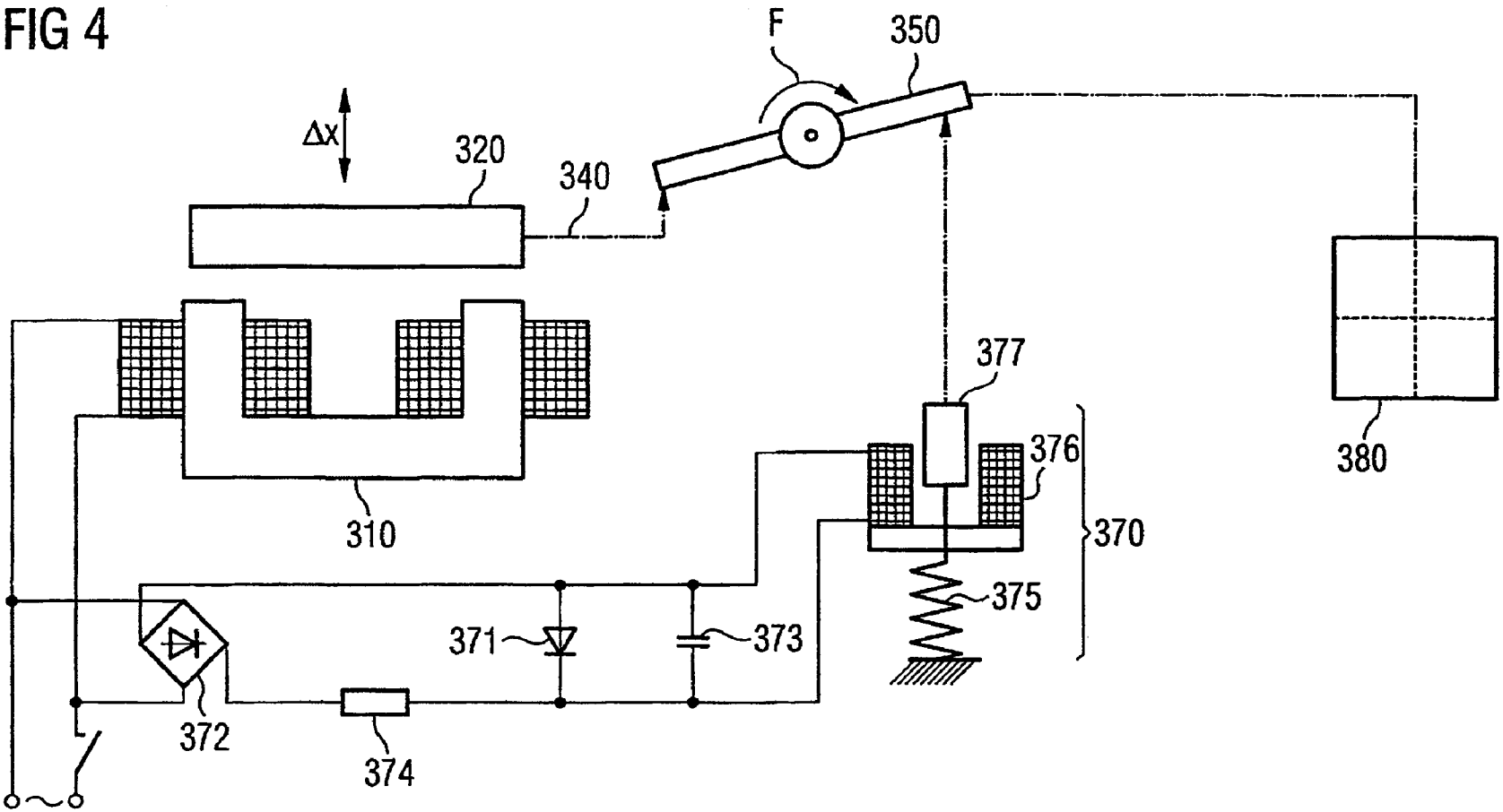
FIG. 4 shows a third embodiment of the apparatus according to the invention.

FIG. 4 shows a third embodiment as an alternative to the embodiment illustrated in FIG. 3, with the contactor being equipped with an AC magnet drive 310. The control circuit for the magnetic initiator 370 is in this case connected via a bridge rectifier 372 to the control circuit of the AC magnet drive 310, and the inert response of the magnetic initiator 370 can once again be produced by way of a freewheeling diode 371. In order to additionally delay the magnetic initiator 370 a charge capacitor 373 can also be connected in parallel with the freewheeling circuit 371, 376 in this case.

In the circuit shown in FIG. 4, the AC magnet drive 310 uses the circuit of the magnetic initiator 370 as a type of freewheeling circuit 371, 376 during disconnection of the control circuit, thus leading to the magnet armature 374 of the magnet drive 310 dropping out with a delay. In order to restrict this delay, a limiting resistor 374 is provided in the initiator circuit. The time constant T of the magnetic-field decay during disconnection of the AC magnet drive 310 is then governed by the time period which is defined by the relationship:

$$T=(L_{magnet\ drive}+L_{initiator})/(R_{magnet\ drive}+R_{initiator}+R)$$

Figure 5:
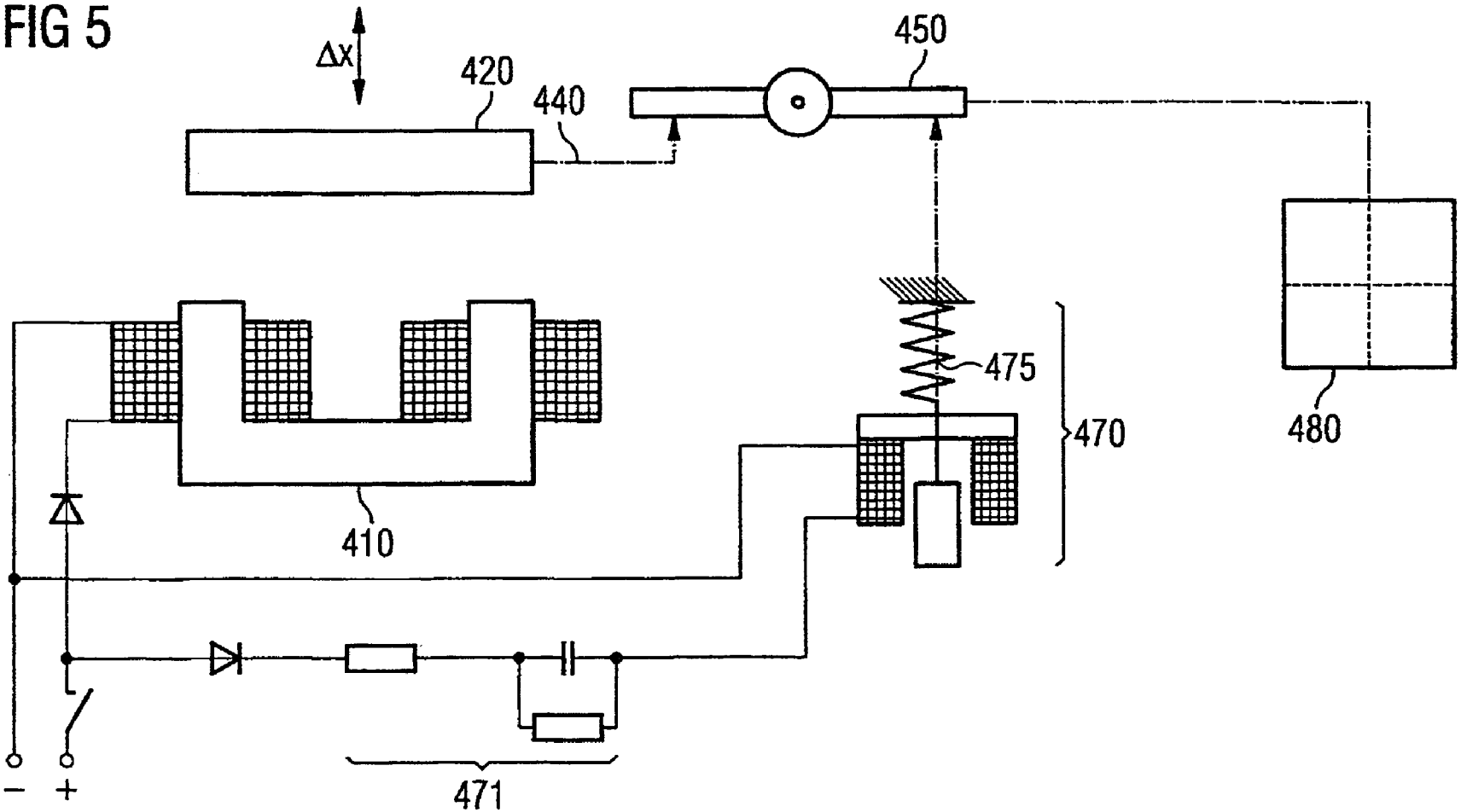
FIG. 5 shows a fourth embodiment of the apparatus according to the invention.

FIG. 5 shows a fourth embodiment of an apparatus for safe operation of a switching device. In this case, the initiation device 450 in fact acts during connection of the normal switching device drive 410.

An actuator 470 is provided for this purpose, which is driven virtually at the same time as the connection signal and whose pulse duration is limited by time control to a predetermined time period, for example of 1 ms to 10 ms. Time control such as this is known to those skilled in the art, both in analog electronics and in digital electronics. A square-wave signal can thus be generated from or for the connection signal of the control magnet 410, on whose rising signal flank a single voltage pulse of predetermined time duration is produced. The time duration, which is predetermined by the time control, or at least a substantial part of it, is referred to as the response time of the actuator 470. During the response time, the actuator 470 can receive sufficient energy for initiation against the actuator holding spring 475 and the latching mechanism latching, if it can move without impediment in the initiation direction.

In the event of contact welding, that is to say when the actuator 470 is not blocked, this actuator 470 releases the latching mechanism 480 without any delay during connection of the normal switching device drive 410. In this case, the mechanical initiation window is governed by the movement distance difference Δx between the disconnected position and the welded position of the moving drive component, and the initiation time window is greater than the predetermined response time of the actuator 470.

When the contacts are not welded, the length of the mechanical initiation window is governed by the movement distance difference Δx between the disconnected position and the instantaneous position of the moving drive component during the drive pulse. This mechanical initiation time window is passed through by the actuator 470 in a time which is shorter than the response time of the actuator 470, so that sufficient energy for initiation of the latching mechanism 480 is not received.

Figure 8:
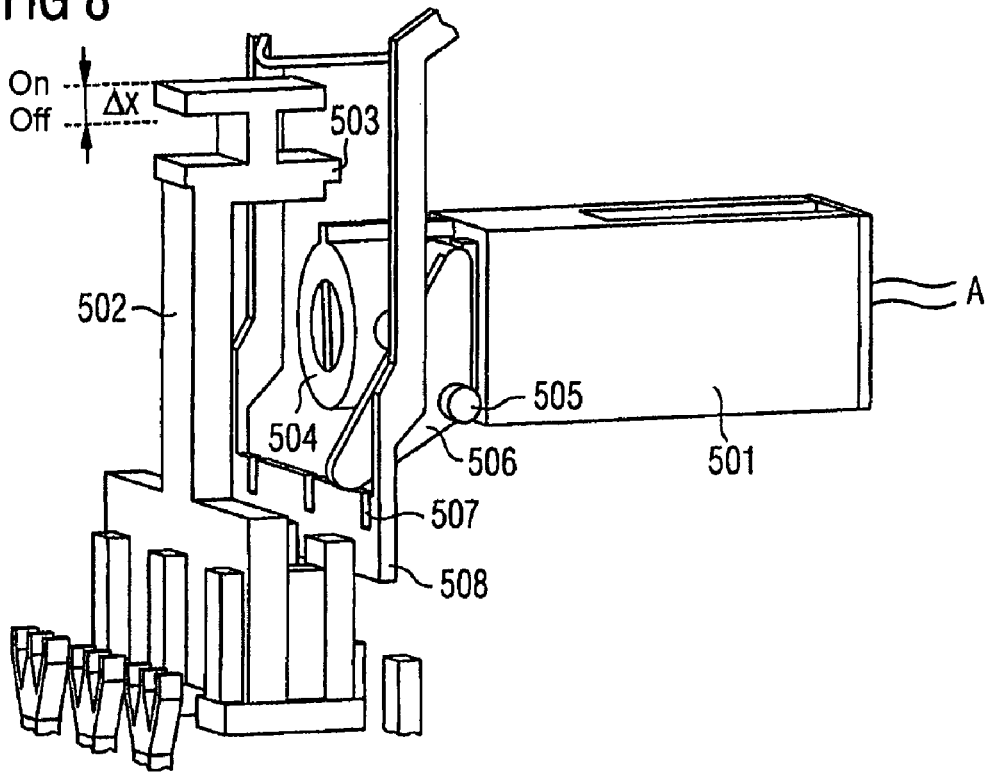
FIG. 8 shows a fifth embodiment of the apparatus according to the invention with a delayed checking element in an on position of a switching device.

FIG. 8 shows a fifth embodiment of the apparatus according to the invention with a delayed checking element 501 in an on position of a switching device. The apparatus according to an embodiment of the invention has a checking element 501 as the initiation device which, after disconnection of the switching device and after a specific time period has elapsed, determines the movement distance difference Δx traveled by an auxiliary contact slide 502. In this case, the auxiliary contact slide 502 is mechanically operatively connected to an armature, which is not shown in any more detail, of a control magnet or electromagnetic drive.

During connection of the switching device, the auxiliary contact slide 502 moves downwards, in the illustrated FIG. 8, with the armature, in order to open the main contacts. The two switch positions of the switching device are annotated with the words "ON" and "OFF" in order to illustrate this. The distance between these two switch positions corresponds to the movement distance difference Δx traveled. The checking element 501 is once again designed according to an embodiment of the invention to initiate means 505-508 to break open welded main contacts when the movement distance difference Δx traveled is less than a predetermined value.

In the example shown in FIG. 8, the checking element 501 is in the form of an actuator. For example, it may be a solenoid, which, when current is passed via the electrical connections A that are shown, extends a cylindrical bolt 504 for mechanical sampling of a position on the auxiliary contact slide 502. In this case, after the disconnection of the switching device, a predetermined time is allowed to pass for the bolt 504 to be extended, with this time, for example, being in the range from 200 ms to 500 ms.

Figure 9:
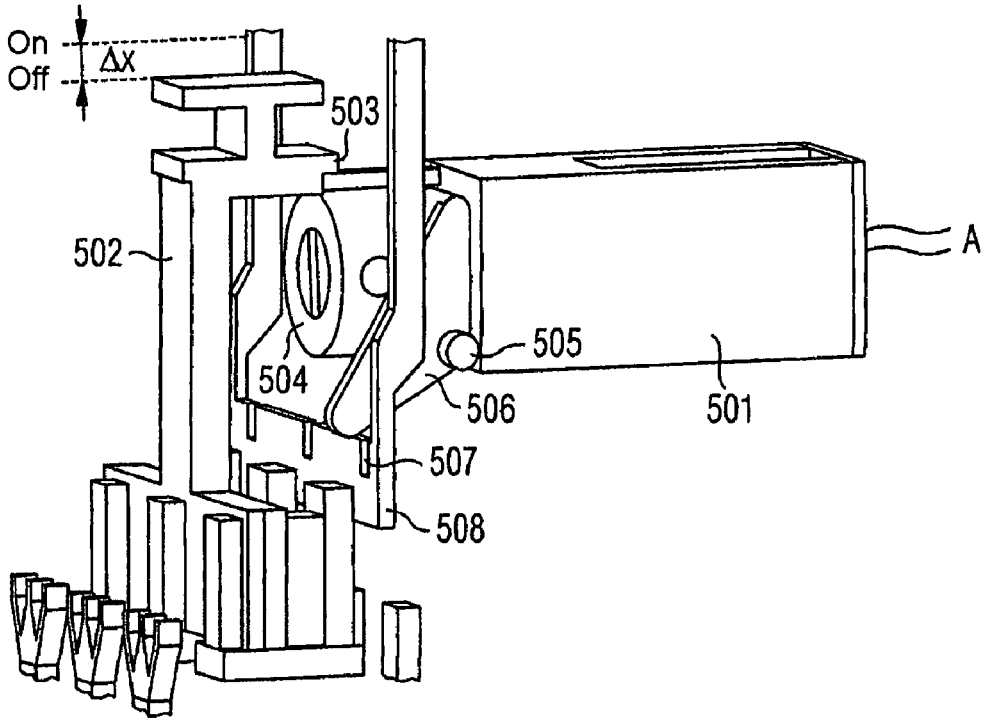
FIG. 9 shows the fifth embodiment as shown in FIG. 8, with the delayed checking element in an OFF position of the switching device.

FIG. 9 shows the fifth embodiment, as shown in FIG. 8, with the delayed checking element 501 in an OFF position of the switching device. FIG. 9 shows the auxiliary contact slide 502 in the "lower" switch position, with a position 503 on the auxiliary contact slide 502 now being sampled. In the present case, the sampling is carried out by the operation of the bolt 504 of the checking element 501 being blocked or restricted 504 by a projection 503 on the auxiliary contact slide 502, which forms the position to be sampled, if the movement distance difference Δx traveled is not less than the predetermined value. In this case, the devices 505-508 for breaking open the main contacts is not initiated.

Figure 10:
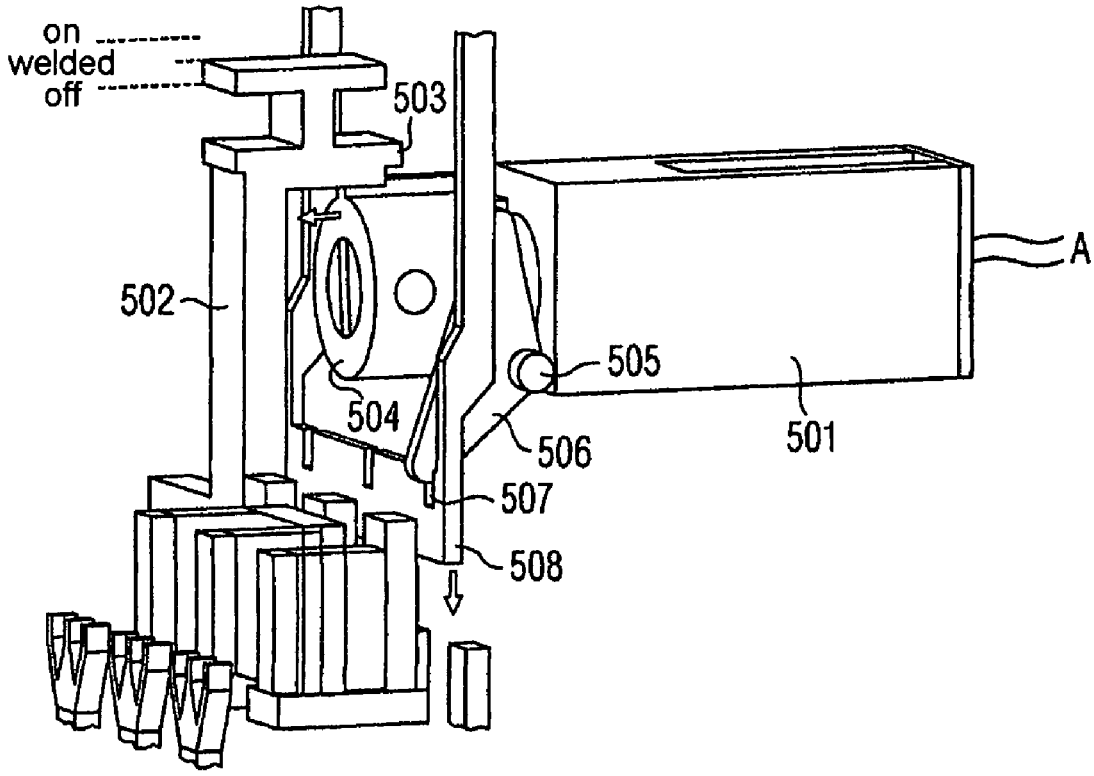
FIG. 10 shows the fifth embodiment as shown in FIG. 8, with the delayed checking element in a "welded" position of the switching device.

FIG. 10 shows the fifth embodiment as shown in FIG. 8 with the delayed checking element 501 in a "welded" position of the switching device. As FIG. 10 shows, the bolt 503 of the checking element 501 is now no longer blocked while being extended, but moves without any impediment out of the housing of the checking element 501. When the auxiliary contact slide 502 is in this position, the movement distance difference Δx is already less than the predetermined value, since the auxiliary contact slide 502, which is connected to the main contact slide that is not shown any further, has not traveled completely to the OFF position. As a result of the unimpeded extension of the actuator or of the bolt 504 of the solenoid 501, the force that is produced in this case is transmitted via a pivoting lever 506, which is mounted in the housing of the solenoid 501 such that it can rotate, to a break-open slide 508, which can then break open the welded main contact. For illustrative purposes, arrows are shown relating to the movements of the bolt 503 of the actuator 501 and of the break-open slide 508.

In FIGS. 8 to 10 of an embodiment of the present invention, the auxiliary contact slide 502 is moved at right angles to the movement direction of the actuator 501 and of the checking element. However, this need not necessarily be the case. It will be just as possible for the checking element to move in the same direction as the auxiliary contact slide 502. For example, the auxiliary contact slide 502 could thus move "downwards" when it is opening the main contacts, and the "delayed" checking and initiation element 501 could move upwards during initiation. If the auxiliary contact slide 502 has then entirely reached its OFF position and its force is stronger than the checking and initiation element 501, then the checking and initiation element 501 is held by the auxiliary contact slide 502. In consequence, it can no longer be initiated.

Alternatively, the switch position of the auxiliary contact slide 502 as shown in FIG. 8 to FIG. 10 can be checked by inductive, capacitive, optical or other known devices for measurement. The components of the checking and initiation element and of the break-open means as described above can advantageously also be combined in a functional unit 501, 504-505, and can be integrated in a modular form in a switching device.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for safe operation of a switching device including at least one connectable/disconnectable main contact, a moving contact link, and at least one control magnet including a moving armature, the armature and the contact link being operatively connected such that the appropriate main contact is closable or openable during connection or disconnection, the method comprising:

identifying a movement distance of greater than zero, which at least one of the armature and a component mechanically connected to and movable with the armature travels through after at least one of connection and disconnection; and initiating at least one device that breaks open welded main contacts, via an initiation device, when the identified movement distance is less than a distance traveled by the at least one of the armature and a component mechanically connected to and movable with the armature when the contacts are not welded and when a specific time period has elapsed after disconnection.

2. The method as claimed in claim 1, wherein the at least one device that breaks open welded main contacts includes a force energy store which is unlatched.

3. The method as claimed in claim 1, wherein the initiating is carried out by way of an initiation lever as the initiation device, the initiation lever being mounted to rotate and operatively connected at one end to the armature and at the other end to at least one device that produces an opposing force.

4. The method as claimed in claim 3, wherein the movement distance difference is identified by way of a ferromagnetic slotted link movable together with the armature and operatively connected to a magnet on the initiation lever, and wherein a magnetic force link between the slotted link and the magnet is cancelled when the movement distance difference traveled by the armature is less than the predetermined value.

5. The method as claimed in claim 1, wherein the movement distance difference is identified by a connection point, between the armature and the initiation lever, which no longer exerts any force on the initiation lever when the movement distance difference traveled by the armature is not less than the predetermined value.

6. The method as claimed in claim 4, wherein, after disconnection and after the specific time period has elapsed, the movement distance difference traveled by the armature and the slotted link is determined by way of a checking element as the initiation device, with the checking element initiating the at least one device that breaks open welded main contacts when the movement distance difference traveled is less than the predetermined value.

7. The method as claimed in claim 6, wherein the checking element is an actuator, operated after disconnection and after the specific time period has elapsed, to sample a position of at least one of the armature and the component connected to the armature, the operation of the actuator being at least restricted by at least one of the armature and the component connected to the armature when the movement distance difference traveled is not less than the predetermined value.

8. The method as claimed in claim 7, wherein, when operation of the checking element is unimpeded, the actuator operates the at least one device operatively and mechanically connected to the actuator, to break open welded main contacts.

9. An apparatus for safe operation of a switching device, the switching device including at least one main connectable/disconnectable contact, a moving contact link, and at least one control magnet including a moving armature, the armature and the contact link being operatively connected such that the appropriate main contact is closable or openable during connection or disconnection, the apparatus comprising:

an initiation device, configured to initiate at least one device that breaks open welded main contacts when, during disconnection, a movement distance of greater than zero traveled by at least one of the armature and a component mechanically connected to and movable with the armature is less than a distance traveled by the at least one of the armature and a component mechanically connected to and movable with the armature when the contacts are not welded, and a specific time period has elapsed after disconnection, wherein the initiation device is an initiation lever, mounted to rotate and operatively connected at one end to the armature via a mechanical coupling device and at the other end to at least one opposing force device that produces an opposing force opposing a retaining force of the armature.

10. The apparatus as claimed in claim 9, wherein the at least one device that breaks open welded main contacts includes a force energy store, unlatchable by the initiation device.

11. The apparatus as claimed in claim 9, wherein the component mechanically connected to the armature is a slotted link that is movable together with the armature, and is operatively connected to a magnet on the initiation lever, wherein a magnetic force link between the slotted link and the magnet is cancelled when the movement distance difference traveled by the armature is less than the predetermined value.

12. The apparatus as claimed in claim 9, wherein the mechanical coupling device is provided between the armature and the initiation lever and is designed such that the coupling device no longer exerts any force on the initiation lever when the movement distance difference traveled by the armature is not less than the predetermined value.

13. The apparatus as claimed in claim 9, wherein a checking element provided as the initiation device determines the movement distance difference traveled by at least one of the armature and the component after disconnection and after the specific time period has elapsed, and initiates the at least one device that breaks open welded main contacts when the movement distance difference traveled is less than the predetermined value.

14. The apparatus as claimed in claim 13, wherein the checking element is an actuator, operable after disconnection and after the specific time period has elapsed, to sample the position of at least one of the armature and the component connected to the armature, with the component connected to the armature at least restricting the operation of the actuator if the movement distance difference traveled is not less than the predetermined value.

15. The apparatus as claimed in claim 14, wherein, if operation of the checking element is unimpeded, the at least one device operatively and mechanically connected to the actuator is operable by way of the actuator to break open welded main contacts.

16. A switching device to carry out the method as claimed in claim 1 for safe switching of loads, the switching device being at least one of a contactor, a circuit breaker and a compact outgoer.

17. A switching device for safe switching of loads including an apparatus as claimed in claim 9, the switching device being at least one of a contactor, a circuit breaker and a compact outgoer.

18. The method as claimed in claim 2, wherein the initiating is carried out by way of an initiation lever as the initiation device, mounted to rotate and operatively connected at one end to the armature and at the other end to at least one device for production of an opposing force.

19. The method as claimed in claim 18, wherein the movement distance difference is identified by way of a ferromagnetic slotted link, is movable together with the armature, and is operatively connected to a magnet on the initiation lever, and wherein a force link between the slotted link and the magnet is cancelled when the movement distance difference traveled by the armature is less than the predetermined value.

20. The apparatus as claimed in claim 10, wherein a ferromagnetic slotted link is provided, is movable together with the armature, and is operatively connected to a magnet on the initiation lever, and wherein a magnetic force link between the slotted link and the magnet being cancelled when the movement distance difference traveled by the armature is less than the predetermined value.

21. The apparatus as claimed in claim 10, wherein a mechanical coupling device is provided between the armature and the initiation lever and is designed such that the coupling device no longer exerts any force on the initiation lever when the movement distance difference traveled by the armature is not less than the predetermined value.

22. The apparatus as claimed in claim 20, wherein a mechanical coupling device is provided between the armature and the initiation lever and is designed such that the coupling device no longer exerts any force on the initiation lever when the movement distance difference traveled by the armature is not less than the predetermined value.

* * * * *